US006341545B1

(12) United States Patent
Gomas

(10) Patent No.: US 6,341,545 B1
(45) **Date of Patent: *Jan. 29, 2002**

(54) JAW ASSEMBLY FOR PIVOTAL HANDLE TOOL WITH OPPOSING JAW ELEMENTS

(75) Inventor: Herve Gilbert Maurice Gomas, Saint Fargeau (FR)

(73) Assignee: Bost Garnache Industries, Arbois (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/077,036

(22) PCT Filed: Sep. 17, 1997

(86) PCT No.: PCT/FR97/01649

§ 371 Date: Oct. 21, 1998

§ 102(e) Date: Oct. 21, 1998

(87) PCT Pub. No.: WO98/13175

PCT Pub. Date: Apr. 2, 1998

(30) Foreign Application Priority Data

Sep. 25, 1996 (FR) ..... 96 11678

(51) Int. Cl.[7] ..... B25B 7/00

(52) U.S. Cl. ..... 81/300; 81/418; 81/421

(58) Field of Search ..... 30/260; 81/300, 81/418, 421

(56) References Cited

U.S. PATENT DOCUMENTS

| | | | | |
|---|---|---|---|---|
| 2,011,622 A | | 8/1935 | Erickson et al. | |
| 3,971,131 A | | 7/1976 | Boyajian et al. | |
| 5,517,762 A | * | 5/1996 | Kuribayashi | 30/260 |

FOREIGN PATENT DOCUMENTS

| | | |
|---|---|---|
| CH | 685749 | 9/1995 |
| DE | 9305733 | 9/1993 |
| FR | 1308849 | 11/1961 |
| GB | 2067451 | 7/1981 |
| GB | 2096041 | 10/1982 |

* cited by examiner

*Primary Examiner*—James G. Smith
(74) *Attorney, Agent, or Firm*—Dowell & Dowell, P.C.

(57) ABSTRACT

Pliers-like tools having opposing and cooperating jaw elements wherein one of the jaw elements includes a heelpiece having a non-circular recess formed therein and in which a mechanical element associated with a jaw carrier portion of a handle is selectively inserted so as to be in non-movable relationship with respect to the one jaw element. Mechanical elements are provided for fastening the handle to the one jaw element at the area of the recess.

20 Claims, 3 Drawing Sheets

VII
VIII
X

JAW ASSEMBLY FOR PIVOTAL HANDLE TOOL WITH OPPOSING JAW ELEMENTS

BACKGROUND OF THE INVENTION

1. Field of the Invention

The present invention relates to pliers-type tools which are operatively connected to manipulate opposing jaws and more particularly to such tools having one jaw of the tool having a fixing heelpiece mounted to a support part of one handle.

2. Description of the Related Art

A number of difficulties are encountered if the jaw is to be made in one piece. On the one hand, the necessary small diameter holes cannot be punched in the jaw. On the other hand, the assembly is fragile because of the high shear stresses exerted on the rivets when the pliers are used.

Pliers-like tools are known and described in GB-A-2 067 451 and CH-A-685 749. These prior art devices have hole problems referred to above and are also relative bulky.

SUMMARY OF THE INVENTION

The aim of the invention is to provide pliers-like tools wherein components of the jaws thereof can be assembled in a highly economic and compact but nevertheless reliable manner.

To this end, the invention consists in pliers of the aforementioned type characterised in that one of the opposing jaws of the pliers includes a heelpiece having a non-circular recess therein in which a mechanical projection associated with a portion of at least one component of a tool handle is selectively inserted and wherein mechanical means are provided through the area of the recess to secure the handle portion to the heelpiece of the jaw element.

The pliers of the invention can have one or more of the features of claims 2 through 12.

BRIEF DESCRIPTION OF THE DRAWINGS

Embodiments of the invention will now be described with reference to the appended drawings, in which.

DESCRIPTION OF THE PREFERRED EMBODIMENT

Figure 1:
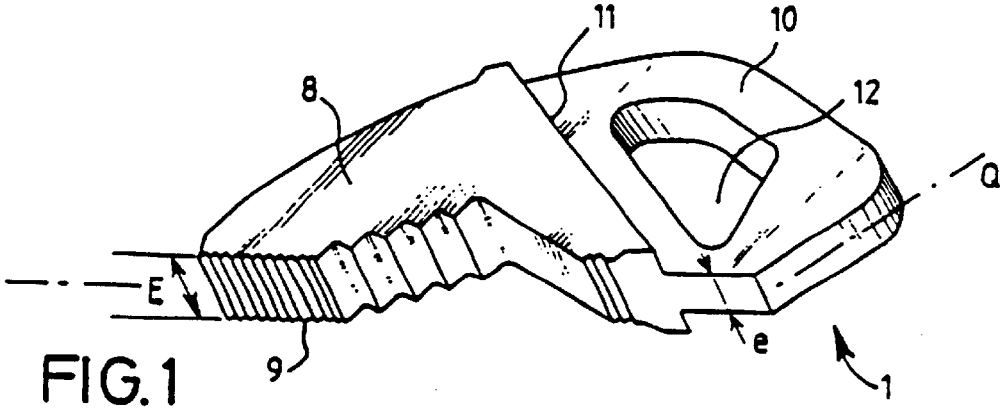
FIG. 1 represents in perspective a jaw of adjustable pliers in accordance with the invention.
Figure 2:
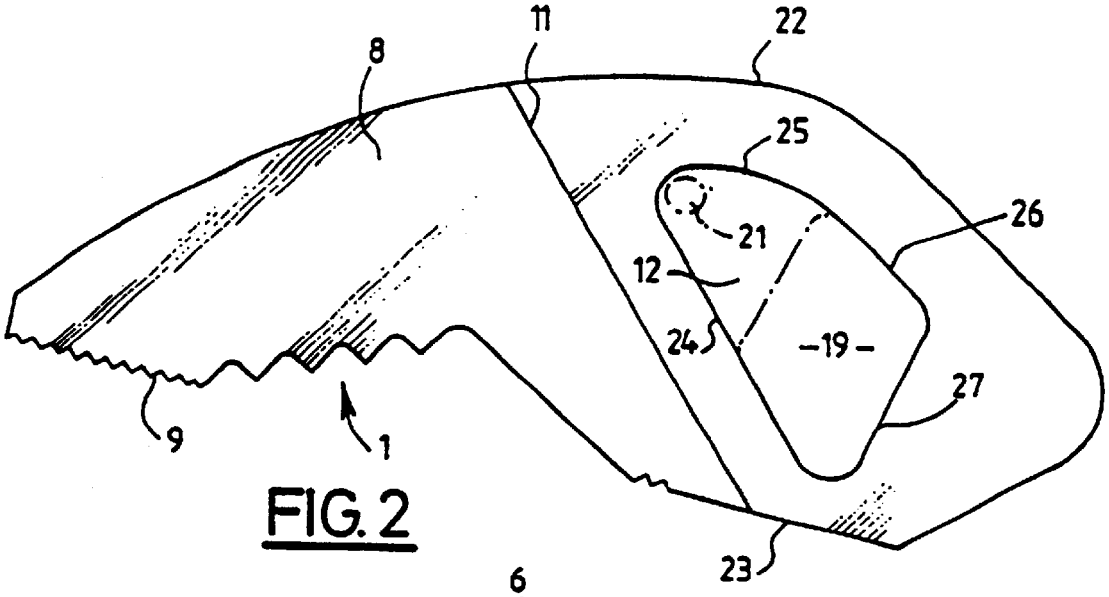
FIG. 2 is a plan view of this jaw to a larger scale.
Figures 5, 6, 7, 8, 9, 10:
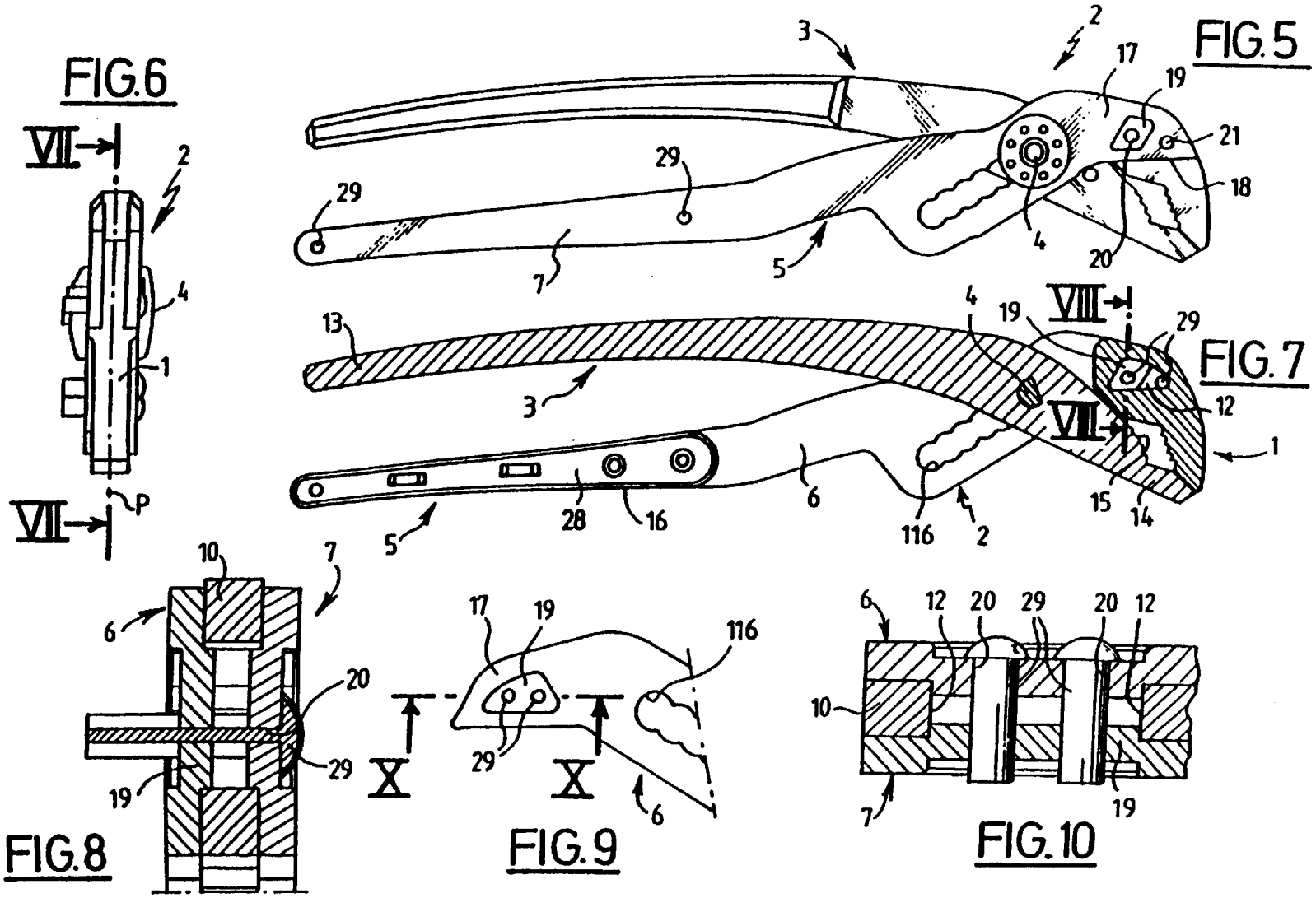
FIG. 5 is a plan view of adjustable pliers constructed from the parts shown in FIGS. 1 and 2, on the one hand, and FIGS. 3 and 4, on the other hand.
FIG. 6 is an end view of the same pliers.
FIG. 7 is a view of the same pliers in section taken along the line VII—VII in FIG. 6.
FIG. 8 is a view of a detail of the pliers to a larger scale and in section taken along the line VIII—VIII in FIG. 7.
FIG. 9 is a partial plan view of a variant embodiment.
FIG. 10 is a view to a larger scale in section taken along the line X—X in FIG. 9.

FIGS. 1 and 2 represent a one-piece jaw 1 for adjustable pliers 2 shown in FIGS. 5 through 7. In addition to the jaw, the pliers 2 comprise a forged interior one-piece handle member 3, a hinge pin 4 attached to the handle 3 and an exterior handle member 5 attached to the jaw 1. The handle member 5 is made of two elongate parts 6, 7 symmetrical to each other about the median plane P of the pliers, which is the section plane of FIG. 7.

The jaw 1, which is called the top jaw, is symmetrical about its own median plane Q which coincides with the plane P when the pliers are assembled. The jaw comprises a thick jaw member 8 the lower active face of which has striations 9 and, to the rear of this jaw member, a plane fixing heelpiece 10. The thickness e of the heelpiece is significantly less than the thickness E of the jaw member and is typically in the order of half the thickness E. For example, e is in the order of 4 mm and E is in the order of 9 mm.

The boundary between the jaw member 8 and the heelpiece 10 forms a rectilinear shoulder 11 perpendicular to the plane Q on either side of the heelpiece. There is a cut-out 12 in the heelpiece over a substantial part of its area.

The handle member 3 is an elongate part which constitutes, in one piece, on one side of the pin 4 the top handle 13 of the tool and on the other side of the pin 4 the bottom jaw 14 of the pliers. The top side of this jaw carries striations 15 and the jaw 14 has the same thickness E as the jaw 1.

One of the two parts of the handle member 5 will now be described, namely the part 6.

One end of the part 6 forms the bottom handle 16 of the tool and there is a slot 116 through an intermediate portion of the part 6. As is usual in adjustable pliers, the slot is elongate and has undulating sides to enable the pin 4 to be put into any one of a plurality of positions along the slot.

Figure 3:
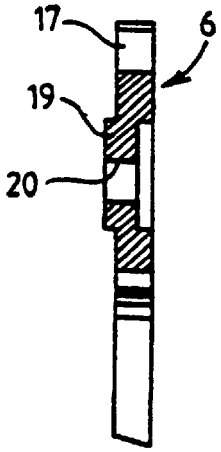
FIG. 3 is a view of a sheet metal handle part to be assembled with the jaw in cross-section taken along the line III—III in FIG. 4.
Figure 4:
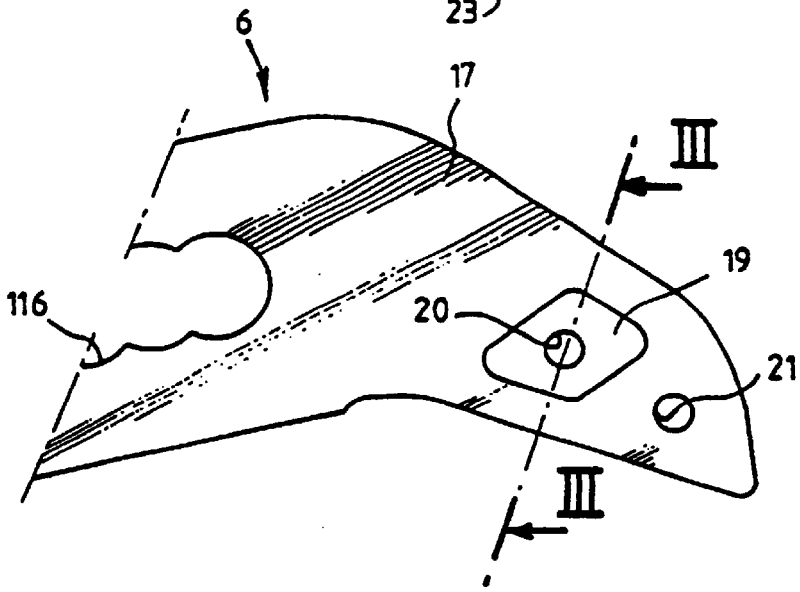
FIG. 4 is a plan view of the part from FIG. 3.

In front of its intermediate portion the part 6 has a jaw-carrier portion 17 the bottom surface 18 of which is rectilinear. The portion 17 has a stamped area that forms a projection 19 on its inside face, a hole 20 punched more or less at the centre of this projection and a hole 21 punched in front of the projection. As is well known to the skilled person, a stamped area of this kind is formed by displacement of the sheet metal in translation in a direction perpendicular to its plane by a distance less than its thickness (FIG. 3).

Referring to FIGS. 2, 4, 5 and 7, it can be seen that the top contour 22 of the heelpiece 10 of the jaw 1 follows that of the portion 17 and that its bottom contour 23 is slightly above the top contour of the bottom jaw 14 when the pliers are closed with the jaws in contact with each other.

The cut-out 12 is not circular, but broadly triangular with rounded corners, and has a rectilinear front surface 24 parallel to the shoulders 11, an arcuate top surface 25 and a rectilinear first rear surface 26, both parallel to the contour 22, and a rectilinear second rear surface 27 at an acute angle, in the order of 45°, to the surface 24 and at an obtuse angle, in the order of 120°, to the surface 26. The surfaces 26 and 24 are at a small acute angle to each other, in the order of 15°.

The projection 19 on the part 6 is the shape of a trapezium with rounded corners which more or less mates with the rear half of the cut-out 12, three of its sides cooperating with the surfaces 24, 26 and 27 of the latter. This is shown in chain-dotted line in FIG. 2 and in continuous line in FIG. 7. When the projection 19 is nested in the cut-out 12 in this way, the front hole 21 is in the radius between the surfaces 24 and 25 (FIG. 2).

To assemble the pliers the parts 6 and 7 are offered up facing each other on respective opposite sides of the handle 3 and the jaw 1 and the two projections 19 are inserted in the cut-out 12. A small space remains between the two projections, as shown in FIG. 8. This positions the heelpiece 10 perfectly parallel to its general plane relative to the parts 6 and 7 and brings each shoulder 11 into contact with the corresponding surface 18. A spacer 28 is provided between the rear portions 16 of the parts 6 and 7 (FIG. 7).

Assembly is then completed by fitting four rivets 29, two of which pass through corresponding holes in the portions 16 and the spacer 28, one of which passes through the holes 20 in the two projections 19 and the last of which passes through the two holes 21 and through the cut-outs 12. Peening this last rivet expands its shank which presses it firmly into the radius between the surfaces 24 and 25 of the cut-out 12.

Finally, the hinge pine 4 of the pliers is fitted, The jaw 1 is perfectly positioned by cooperation of the projections 19 with the cut-out 12 and by cooperation of the shoulders 11 of the jaw 1 and the surfaces 18 of the parts 6 and 7, these shoulders and these surfaces forming bearing surfaces which withstand the clamping forces. Consequently, the front rivets 29 are not loaded in shear during use of the pliers and merely hold the three parts 1, 6 and 7 pressed together. The holes 20 and 21 for these rivets are made in the two sheet metal parts 6, the thickness of which is typically in the order of 2.5 mm, and can therefore be punched in these two parts with a very small diameter, for example 3 mm. This would not be possible in the heelpiece 10, the thickness of which is in the order of 4 mm, as indicated above.

In the variant of FIGS. 9 and 10 the projections 19 mate with all of the cut-out 12 and two holes 20 are punched in each of the projections for the two front rivets 29 to pass through. The projections 19 can be forcibly inserted into the cut-out 12 if necessary.

Figure 11:
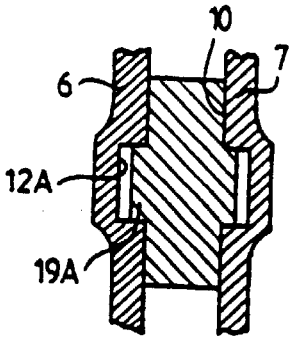
FIG. 11 is a partial view in cross-section of a second variant embodiment.

As shown diagrammatically in FIG. 11, in another variant the heelpiece 10 is solid and has a projection 19A on each face, and each part 6, 7 has a stamped area projecting outwards that forms an inside recess 12A. Each projection 19A mates with at least part of the contour of the corresponding recess 12A, in the sense explained above with reference to FIGS. 1 through 10, and holes 20, 21 and front rivets 29 are disposed in a corresponding manner. The heelpiece includes at least one rivet hole, preferably outside the increased thickness areas 19A. Note that in this variant, to obtain a hole or holes in the heelpiece with a diameter as small as previously the heelpiece must be machined (drilled).

Figure 12:
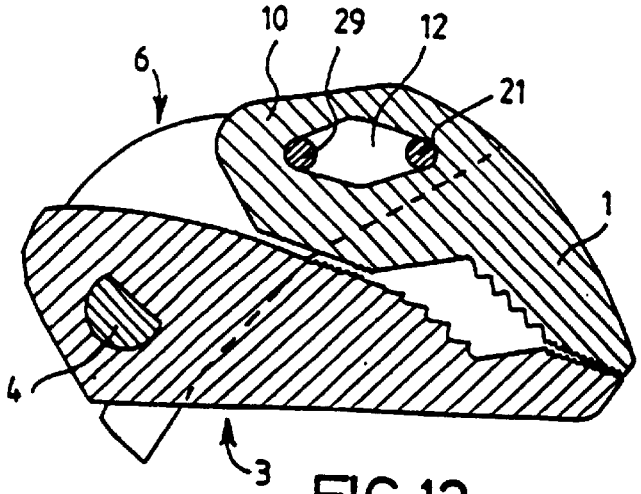
FIG. 12 is a partial view in longitudinal section of a third variant embodiment.

In the FIG. 12 variant the heelpiece 10 again has a cut-out 12, although of oblong shape, with rounded ends and a major axis more or less parallel to the top surface of the parts 6 and 7. The latter do not have the projections 19 but include two punched holes 21 each inscribed within one of the radii at the longitudinal ends of the cut-out. The parts 1, 6 and 7 are simply assembled by means of two front rivets 29 through the holes 21. When these rivets are peened their shank expands and they are therefore pressed firmly against the rounded ends of the cut-out.

Note that in this variant the rivets are loaded in shear. Consequently the holes 21 and the rivets have a larger diameter than in the variants previously described.

Figure 13:
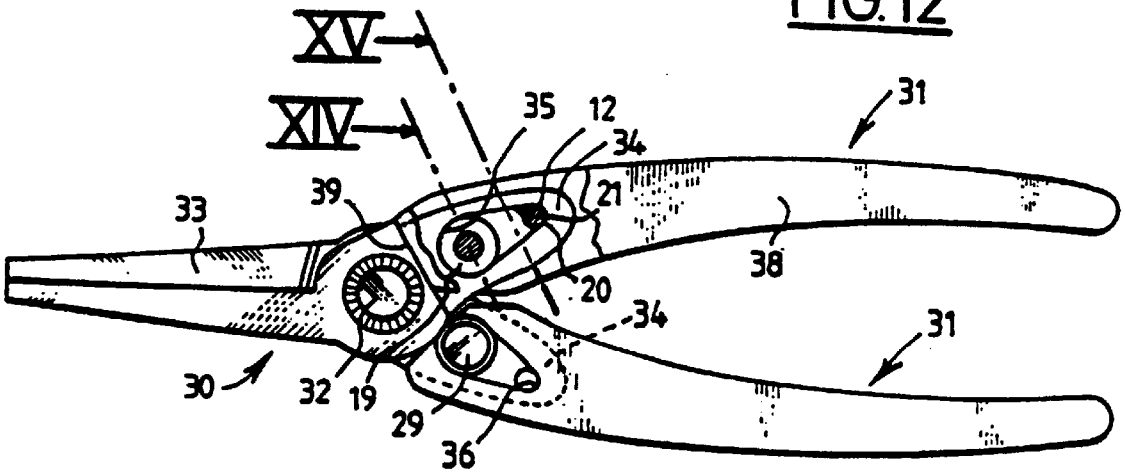
FIG. 13 shows flat nose pliers in accordance with the invention.
Figure 14:
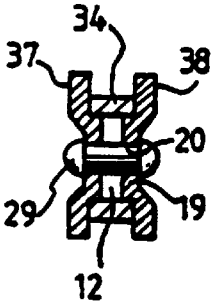
FIGS. 14 and 15 are partial views in section taken along the lines XIV and XV in FIG. 13, respectively.
Figure 15:
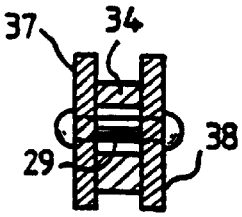

FIGS. 13 through 15 show an application of the invention to flat nose pliers. The pliers comprise two one-piece jaws 30 each assembled to a handle 31. The two jaws 30 are hinged together by a fixed pin 32. In front of the pin they form a jaw proper (or nose) 33 and they are extended beyond the pin 32 by a thinner rear fixing heelpiece 34 in one piece with them.

Each heelpiece has a non-circular cut-out 12 consisting in this example of a front circular arc 35 of relatively large radius, a rear circular arc 36 of relatively small radius and two tangents common to these two arcs.

Each heelpiece 34 locates between two sheet metal parts 37, 38 which together form the corresponding handle 31 and each of which has a circular stamped area 19. The inwardly projecting stamped area 19 forms a projection that mates with the front arc 35. A rivet 29 passes through central holes 20 in the projections 19 and another rivet 29 passes through rear holes 21 in the parts 37 and 38 inscribed within the rear arcs 36. At the front each sheet metal part has a rectilinear edge 39 that cooperates with a rectilinear shoulder of the part 30 situated at the root of the heelpiece 34.

Note that if the handle of the pliers is positioned relative to the attached part 1, 30 by means of a surface such as the surfaces 18 or 39 the assembly could alternatively include circular projections like the projections 19 from FIG. 13 nested in a circular recess. If the circular projections are stamped areas in sheet metal parts, the advantage is again obtained of being able to punch small diameter rivet holes.

It is to be understood that the invention applies equally to fixing any tool jaw to any support part, which can be made not only from sheet metal but also from plastics material, aluminium, etc.

What is claim is:

1. A pliers-type tool having first and second handles which are operatively connected to manipulate opposing jaws comprising:

one of the opposing jaws including a one-piece tool jaw including a jaw fixing heelpiece, said heelpiece have a recess therethrough, said recess having a peripheral surface:

a first jaw support part having a general plane said first jaw support part comprising a first jaw carrier portion, said first jaw carrier portion having positioning means which position said heelpiece relative to said first jaw carrier portion parallel to said general plane in every direction of said plane, said positioning means comprising a protrusion seated within said recess; and securing means extending through said recess and securing said one-piece tool jaw to said first jaw support part.

2. The pliers-type tool of claim 1, wherein said recess is formed as a cut-out in said heelpiece.

3. The pliers-type tool of claim 1, wherein said recess is non-circular.

4. The pliers-type tool of claim 1, wherein said positioning means further comprises mutually cooperating respective shoulder means on said one-piece tool jaw and on said first jaw support part, and said shoulder means being spaced from said recess.

5. The pliers-type tool of claim 4, wherein said shoulder means are rectilinear.

6. The pliers-type tool of claim 1, wherein said protrusion engages only a portion of said peripheral surface.

7. The pliers-type tool of claim 6, wherein said securing means includes a mechanical securing member extending through said recess and spaced from said protrusion.

8. The pliers-type tool of claim 7, wherein said securing member is a rivet.

9. The pliers-type tool of claim 1, wherein said securing means includes a mechanical securing member extending through a hole in said protrusion.

10. The pliers-type tool of claim 9, wherein said securing member is a rivet.

11. The pliers-type tool of claim 1, wherein said protrusion engages substantially an entire peripheral surface of said recess.

12. The pliers-type tool of claim 1, wherein said protrusion is of a size to be forcibly inserted in said recess.

13. The pliers-type tool of claim 1, wherein said first jaw support part is made of sheet metal and said projection is a stamped area of said first jaw support part.

14. The pliers-type tool of claim 1, further comprising a second jaw support part having a second jaw carrier portion, said heelpiece being sandwiched between said first and second jaw carrier portions and said securing means holding said first and second jaw carrier portions and said heelpiece pressed together.

15. The pliers-type tool of claim 14, wherein said second jaw support part is substantially symmetrical to said first jaw support part in a region of said recess.

16. The pliers-type tool of claim 1, wherein said pliers-type tool is an adjustable pliers.

17. A pliers-type tool having first and second handles which are operatively connected to manipulate opposing tool jaws, comprising:

one of said opposing tool jaws including a one-piece tool jaw including a jaw fixing heelpiece, said heelpiece having a recess therein, said recess having a peripheral surface;

a first jaw support part having a general plane, said first jaw support part comprising a first jaw carrier portion, and two mechanical securing members which extend through said recess and bear on opposite regions of said peripheral surface to secure said one-piece tool jaw to said first jaw support part.

18. The pliers-type tool of claim 17, further comprising a second jaw support having a second jaw carrier portion, said heelpiece being sandwiched between said first and second jaw carrier portions and said securing members holding said first and second law carrier portions and said heelpiece pressed together.

19. The pliers-type tool of claim 18, wherein said second jaw support part is substantially symmetrical to said first jaw support part in a region of said recess.

20. The pliers-type tool of claim 17, wherein said pliers-type tool is an adjustable pliers.

* * * * *